United States Patent [19]

Thomas

[11] Patent Number: 4,739,552

[45] Date of Patent: Apr. 26, 1988

[54] PLIERS, PARTICULARLY FOR REMOVING CUTICLES

[75] Inventor: Dieter Thomas, Haan, Fed. Rep. of Germany

[73] Assignee: Excellent Gesellschaft für Feine Schneidwaren mbH, Solingen, Fed. Rep. of Germany

[21] Appl. No.: 901,026

[22] Filed: Aug. 27, 1986

[30] Foreign Application Priority Data

Feb. 28, 1986 [DE] Fed. Rep. of Germany ... 5 MR 9650
Apr. 17, 1986 [DE] Fed. Rep. of Germany ... 8610516[U]

[51] Int. Cl.[4] ..... A45D 29/00
[52] U.S. Cl. ..... 30/28
[58] Field of Search ..... 30/28; 81/427, 321, 81/322, 323

[56] References Cited

U.S. PATENT DOCUMENTS 1,061,358 5/1913 Culver ..... 81/322
2,839,827 6/1958 David ..... 30/28

*Primary Examiner*—E. R. Kazenske
*Assistant Examiner*—Willmon Fridie, Jr.
*Attorney, Agent, or Firm*—Michael J. Striker

[57] ABSTRACT

A pliers for cuticles includes a pair of gripping arms having cutting blades, and an opening leaf spring positioned between the gripping arms and carrying at one end thereof plastic sliding element sliding against the inner surface of one of the gripping arms and anchored in an opening formed in the end portion of the leaf spring.

3 Claims, 2 Drawing Sheets

FIG. 1
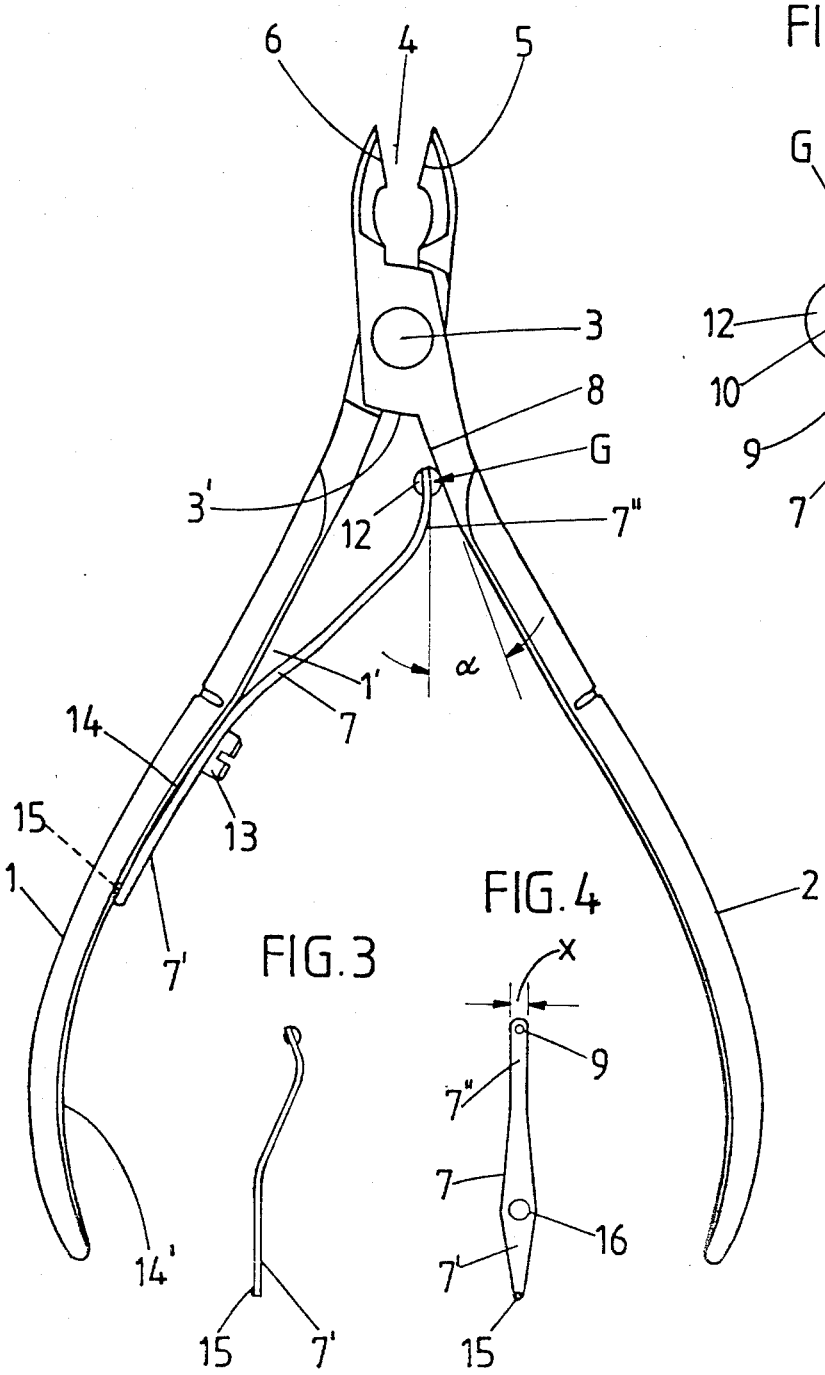
FIG. 2
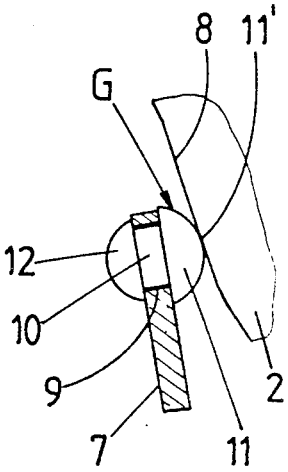
FIG. 3
FIG. 4

PLIERS, PARTICULARLY FOR REMOVING CUTICLES

BACKGROUND OF THE INVENTION

The present invention relates to pliers, particularly to pliers for removing cuticles.

Pliers of the type under consideration have been known, which cuticle pliers included a sliding element made of hardenable plastic by an immersion method. The fixing of such a sliding element has been insufficient in view of usual sterilization problems. Finally, one had to compromise in regard to the rigidity of the utilized synthetic plastic material and the sterilization capacity.

SUMMARY OF THE INVENTION

It is an object of the present invention to provide an improved cuticle pliers.

It is a further object of the present invention to provide a plier in which a leaf spring would be provided with a sliding element which would be manufactured by injection molding and would meet hygienic requirements.

These and other objects of the invention are attained by a pliers, particularly for cuticles, comprising two pivotable gripping arms; and an opening leaf spring positioned between said arms, said leaf spring being resistant to bending and having one end portion snugly lying against an inner surface of one of said arms and another end portion carrying a plastic sliding element sliding against an inner surface of another of said arms, said spring having at least one opening in which said element is anchored.

The sliding element may be a rivet inserted in said opening and having a rivet head projecting outwardly from said spring and having a sliding surface.

The rivet may be formed as a round head rivet.

The diameter of said rivet head may substantially correspond to a width of an end of said another end portion of said spring, said rivet head being completed with a ball-shaped portion to form a pearl-shaped sliding element in a diametrical plane of which said another end portion of said spring extends.

The spring may be pivotally connected to said one arm and is pivotable about an axis perpendicular to said inner surface of said one arm, said ball-shaped portion having an attack surface spaced from said inner surface of said one arm, a free end of said spring being offset relative to said attack surface.

Notches may be formed in side flanks of said spring, said notches constituting openings in which said element is anchored.

The pliers according to the invention is easy to manufacture and it meets sterilization requirements. The engagement of sliding element in the opening or notches of the leaf spring provides a reliable anchoring. The extension of the opening is optimal. For example, pockets of hardenable plastic or walls of a shoe-like sliding element can be made by injection molding of one or more material webs. On the other hand, the structure of the sliding element as a rivet is advantageous. Such sliding element can be produced in customary devices by thermal immersion methods. If the sliding element is a rivet its shaft extends in the opening of the leaf spring transversely thereof. The rivet can have a head with a sliding surface. The round-shaped rivet head provides a good sliding motion of the sliding element along the inner surface of the gripping arm. The ball-shaped sliding surface provides a friction source that increases the service life of the pliers.

The pearl-shaped sliding element permits to avoid the danger of displacement in the region of the narrow end of the leaf spring. The ball-shaped portion of the sliding element provides a very stable structure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a side view of the pliers with the opening leaf spring in an expanded position;

FIG. 2 is a side view of a plastic sliding element at the end of the opening leaf spring, on an enlarged scale;

FIG. 3 is a side view of the opening leaf spring of a bend-over profile and provided with the sliding element;

FIG. 4 is a front view of the opening leaf spring with the sliding element removed therefrom;

DETAILED DESCRIPTION OF THE PREFERRED EMBODIMENTS

Figure 5:
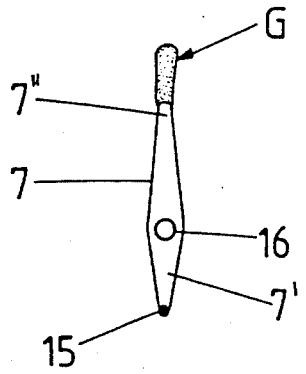
FIG. 5 is a front view with the sliding element of a modified embodiment.
Figure 6:
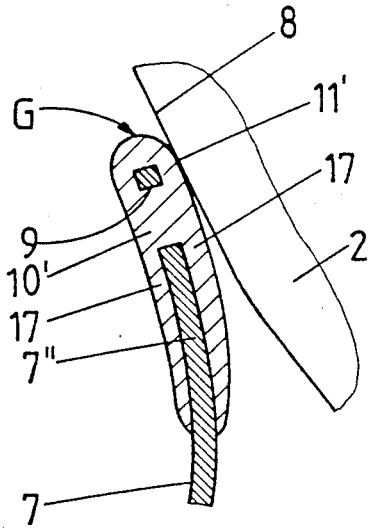
FIG. 6 is a side view of the plastic sliding element at the end of the leaf spring of the modified embodiment, on an enlarged scale.

A pliers, particularly for removing cuticles, is comprised of gripping arms 1 and 2 which cross each other in the region of operating. A connecting pin which connects arms 1 and 2 to each other is designated by reference numeral 3. Arms 1 and 2 are terminated with a plier jaw 4 which is formed by two cutting blades 5 and 6.

When gripper arms 1 and 2 are expanded the jaw 4 is held in the open position so that the manipulating of the plier is limited to the pressing of the gripping arms 1 and 2 against each other. An easy operation of the pliers is obtained by an opening leaf spring 7. The latter lies snugly on an inner side 1 of the gripping arm 1. This spring has one end 7' which corresponds to the gripping arm 1 and is resistant to bending. The other end 7'' is spaced from the inner side 1' of arm 1 and extends substantially within the region of operating of the plier, in the direction towards the other gripping arm 2 where it is in contact with the inner surface 8 of arm 2. The other end 7'' defines the expansion position of the pliers which position can be exceeded by a further expansion of the gripping arms 1 and 2, for example for sharpening cutting blades 5, 6. This movement is obtained however with a certain resistance by a respective friction-dependent insertion of the connecting pin 3. On the other hand, the operation surfaces can be easily raised in this direction.

End 7'' of the opening leaf 7 is reinforced with a sliding element G made of synthetic plastic material. This sliding element is anchored in an opening or openings of the leaf spring 7 and slides over the above mentioned inner surface 8, upon the operation of the pliers in the direction of closing of the jaw 4, also for example during the cutting movement.

The plastic sliding element G is formed in the embodiment of FIGS. 1 to 3 as a rivet. For the insertion of this rivet the free end 7″ of the opening leaf spring has a through opening 9. This opening receives a shaft 10 of the rivet. This opening can be drilled or made by stamping. The front edge of the end 7″ extends concentrically to the wall of that opening. A sliding surface 11, which slides on the inner surface 8, is formed as a round head as clearly shown in FIG. 2. The fixing of the rivet takes place in the path of the deforming of the shaft 10. By selection of a respective material a thermal deformation is taken into consideration.

In order to prevent direct contact between the leaf spring 7 made of steel, that is its end 7″ and the inner surface 8 of the pliers arm, the rivet head 11 has the diameter which substantially corresponds to the width X of the end 7″ of the opening leaf spring. This width may be somewhat below the diameter of the rivet head 11.

A ball 12 provided at the back side of the rivet head 11 and extended towards the gripping arm 1 adds to the shape of the rivet head so that as a whole it has the shape of a pearl whereby the opening leaf spring 7 extends substantially in the diametral plane of this rivet head.

In the opening initial position of the pliers shown in FIG. 1, the free end 7″ of the opening leaf spring 7 includes an acute angle $\alpha$ with the inner surface 8 of the gripping arm 2. Upon the closing movement of the pliers, this acute angle is reduced until the inner surface 8 comes to the position parallel to the free end 7″.

The leaf spring 7 has in the direction of the pin 3 such a length that in the closed position of the pliers, the sliding element G remains at the sufficient distance from the surface 3′ of the operation region of the plier so that no mechanical loading can exert on the plastic sliding element. The latter is positioned in the wedge-shaped zone.

The opening leaf spring 7 can be pivoted about the axis formed by a bolt 13 from the plane of movement of the gripping arms 1 and 2 and brought, for example to the position in which the free end 7″ of the opening leaf spring 7 lies before a concave portion 14′ of inner surface 14 of the gripping arm 1. This position is selected when a respective force storage must not be utilized. The through opening in the spring 7 for the shaft of the bolt 13 is designated at 16.

The force-storing practical position of the opening leaf spring 1, as shown in FIG. 1 is a stopping position. The end 7′ of the leaf spring 7 has for this purpose a locking or stop projection 15 which cooperates with a locking recess provided in the inner surface 14 of the gripping arm 1. Due to the S-shaped bent structure the end 7″ of the spring is under a spring loading in the locking engagement direction.

Because the opening leaf spring 7 is pivotally connected on the axis extending perpendicular to the inner surface 14 of the gripping arm 1, and the ball 12, in the reverse position of the leaf spring, projects outwardly to the inner surface 14, the attack surface is formed, relative to which the free front edge of spring 7 is offset rearwardly. So, upon the pivoting of the leaf spring 7 a hinge movement results so that the gripping arm 1 is not scratched. The rivet-carrying end deflects in a slightly resilient fashion.

Polypropylene regenerate, known in practice as Hostalene, can be utilized for producing the sliding element G.

The opening leaf spring shown in FIG. 5 corresponds in shape to the spring of FIG. 4. In place of the rivet in the embodiment of FIG. 5 opening 9 receives a web 10′ corresponding to shaft 10 and formed by material filling of the sliding element G produced by injection molding or immersion. In this manner a shoe is formed, which extends further in the direction of opening 16, as for example the material of the rivet of FIG. 2. The web 10′ merges into a wider wall portion 17 of the shoe. The region extending before the end 7″ of the leaf spring is thereby fully coated. The front end of the sliding element is rounded in both transversal directions.

Figure 7:
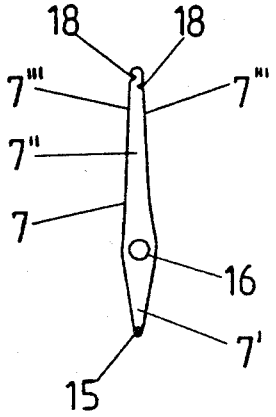
FIG. 7 is a further modification of the opening leaf spring having no plastic sliding element thereon.
Figure 8:
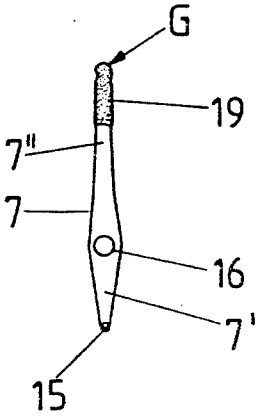
FIG. 8 is a front view of the leaf spring of FIG. 7 with the sliding element arranged thereon.

A further modification of the leaf spring illustrated in FIGS. 7 and 8 differs from the above described embodiments in that the openings causing the anchoring of the plastic sliding element G are formed as notches 18 of the narrow side flanks 7‴ of the opening leaf spring. In this modification, each side flank 7‴ of the end 7″ of the spring is provided with such a notch. These notches can be offset relative to each other in the direction of elongation. The notch peak reaches approximately up to the axis of symmetry of the leaf spring. The respective offsetting leads to an S-shaped structure. The end 7″ can be also formed by injection molding, or immersion, or deforming or by extending of a portion from a shrinkable material.

It will be understood that each of the elements described above, or two or more together, may also find a useful application in other types of pliers differing from the types described above.

While the invention has been illustrated and described as embodied in pliers for removing cuticles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pliers, particularly for cuticles, comprising two pivotable metallic gripping arms; and a metallic opening leaf spring positioned between said arms, said leaf spring being resistant to bending and having one end portion snugly lying against an inner surface of one of said arms, and another end portion carrying a plastic sliding element having a round sliding surface which slides against an inner surface of another of said arms whereby contact between said metallic spring and said inner surface is prevented, said spring having at least one opening in which said element is anchored, said sliding element being a rivet inserted in said opening and having a round head projecting outwardly from said spring.

2. The pliers as defined in claim 1, wherein a diameter of said rivet head substantially corresponds to a width of an end of said another end portion of said spring, said rivet head being completed with a ball-shaped portion to form a pearl-shaped sliding element in a diametrical plane of which said another end portion of said spring extends.

3. A pliers, particularly for cuticles, comprising two pivotable metallic gripping arms; and a metallic opening leaf spring positioned between said arms, said leaf spring being resistant to bending and having one end portion snugly lying against an inner surface of one of said arms, and another end portion carrying a plastic sliding element having a round sliding surface which slides against an inner surface of another of said arms whereby contact between said metallic spring and said inner surface is prevented, said spring having at least one opening in which said element is anchored, said sliding element being a rivet inserted in said opening and having a round head projecting outwardly from said spring, a diameter of said head substantially corresponding to a width of an end of said another end portion of said spring, said head being completed with a ball-shaped portion to form a pearl-shaped sliding element in a diametrical plane of which said another end portion of said spring extends, said spring being pivotally connected to said one arm and being pivotable about an axis perpendicular to an inner surface of said one arm, said ball-shaped portion having an attack surface spaced from the inner surface of said one arm, a free end of said spring being offset relative to said attack surface.

* * * * *